US006206248B1

(12) United States Patent
Popp et al.

(10) Patent No.: US 6,206,248 B1
(45) Date of Patent: Mar. 27, 2001

(54) DISPENSING PISTON FOR COMMODITY CONTAINER

(76) Inventors: James L. Popp; Carolyn Popp, both of 55 Winthrop New Rd., Aurora, IL (US) 60506; James A. Dean, 409 S. Van Buren St., Batavia, IL (US) 60510

( * ) Notice: Subject to any disclaimer, the term of this patent is extended or adjusted under 35 U.S.C. 154(b) by 0 days.

(21) Appl. No.: 09/293,599

(22) Filed: Apr. 16, 1999

(51) Int. Cl.[7] ..... B67D 5/46

(52) U.S. Cl. ..... 222/389; 222/386; 141/287; 277/467; 277/468; 277/472; 277/646

(58) Field of Search ..... 222/386, 389; 141/287; 277/467, 468, 472, 646

(56) References Cited

U.S. PATENT DOCUMENTS

| | | | | |
|---|---|---|---|---|
| 486,691 | * | 11/1892 | Cirkel | 222/389 |
| 1,630,899 | * | 5/1927 | Lynch | 222/389 |
| 1,892,519 | | 12/1932 | Schottgen . | |
| 2,559,564 | | 7/1951 | Sperling . | |
| 3,043,340 | | 7/1962 | Rehbock . | |
| 3,113,705 | | 12/1963 | Weitzel . | |
| 3,178,779 | * | 4/1965 | Clark et al. | 277/646 |
| 3,203,674 | | 8/1965 | Watson . | |
| 3,321,110 | | 5/1967 | Price . | |
| 3,690,742 | | 9/1972 | Sung . | |
| 3,808,816 | | 5/1974 | Lucas . | |
| 3,828,988 | | 8/1974 | Berry | 222/389 |
| 3,940,152 | | 2/1976 | Fournier | 277/34 |
| 4,178,000 | | 12/1979 | Kuttner | 277/138 |
| 4,342,336 | | 8/1982 | Satterthwaite et al. | 138/90 |
| 4,355,736 | | 10/1982 | Schumacker et al. | 222/80 |
| 4,624,465 | | 11/1986 | Rogcmont . | |
| 4,632,281 | | 12/1986 | Wold | 222/389 |
| 4,721,235 | | 1/1988 | Watson | 222/389 |
| 4,859,121 | | 8/1989 | Deysson et al. . | |
| 4,899,910 | * | 2/1990 | Tabei et al. | 222/386 |
| 5,114,054 | | 5/1992 | Watson | 222/389 |
| 5,312,389 | * | 5/1994 | Theeuwes et al. | 222/389 |
| 5,328,177 | * | 7/1994 | Lair et al. | 277/468 |
| 5,341,726 | | 8/1994 | Watson | 92/80 |
| 5,492,249 | * | 2/1996 | Beach | 222/389 |
| 5,746,112 | | 5/1998 | Watson | 92/205 |

FOREIGN PATENT DOCUMENTS

| | | |
|---|---|---|
| 2 594 199-A1 | 8/1987 | (FR) . |
| 267688 | 9/1926 | (GB) . |
| 55-44146 | 3/1980 | (JP) . |

* cited by examiner

*Primary Examiner*—J. Casimer Jacyna
(74) *Attorney, Agent, or Firm*—Brinks Hofer Gilson & Lione

(57) ABSTRACT

A piston for dispensing material from a commodity container includes a nose section connected to a piston shaft. A recessed channel is located between the nose section and piston shaft. In the channel, there is a seal lifter over which a solid wiping seal is placed. Upon inflation, the seal lifter forcers the wiping seal to extend beyond the periphery of the piston to come into sealing contact with the interior wall of the container.

18 Claims, 16 Drawing Sheets

DISPENSING PISTON FOR COMMODITY CONTAINER

BACKGROUND OF THE INVENTION

The present invention is related to pistons used to dispense commodity material from storage, processing and transport containers.

More and more industrial companies are using commodity materials in their manufacturing processes that will prematurely cure if exposed to air or moisture and/or that have chemical vapors that must be contained. Some of these materials are highly viscous or are fluids that must be evenly dispensed into processing equipment without fluctuations in the flow. Some pumps can cause even the most minor of fluctuations in the flow of material that is still too much variation for the sensitivity of some production equipment. Further, many of the materials used in manufacturing are blended with very expensive compounded chemicals. Also, it is very expensive to dispose of or to recycle chemical residues, and any loss of material adds to the cost of manufacturing. Therefore, commodity material consumers need the ability to fill a tank and then remove almost all of the viscous, non-flowable, sensitive material out of a tank without ever opening the tank and/or to push material at an even flow rate out of the tank without a pump.

One method practiced by the industry to dispense material from the tank is to use a piston inside of the tank that is pushed through the tank during the dispensing process by the use of pressurized air, nitrogen or any other gas. The piston moves in the opposite direction when the tank is filled with material by the material itself pushing the piston in the opposite direction. Any air, nitrogen or any other gas is vented out of the tank during the re-filling operation.

Generally, it is known that tanks with dispensing pistons can be used to dispense a wide range of materials, ranging from non-flowable materials to low viscosity liquids. Also, the tanks can be as small as drums and as large as a bulk storage tank. The tanks can be stationary, or moveable by such methods as, but not limited to, fork lift trucks, trucks, rail, ship, airplanes.

Generally, tanks with dispensing pistons have been used for many years. These pistons were designed originally for use in large trailerable tank trucks.

Such trailerable tanks are large in diameter, approximately 68 inches. Often the interior surface of these tanks is not perfectly round the whole length of the tank, and the tanks are made to flex as the tanks are pulled down the highway. This flex can cause distortion of the interior diameter surface inside of the tank over time. Therefore, the dispensing pistons that were previously designed for the trailer tank trucks had to take this into consideration.

The previous design required that the diameter of the rigid portion of the piston member could not be made with close dimensional tolerances to the inside diameter dimension of the tank wall. Because the diameter of such pistons were much smaller than the inside diameter of the tank wall, canting of the piston during dispensing and filling of the tank was a problem that required the use of anti-canting pads, rings and/or other materials on the outside surface of the piston. Those anti-canting devices prevent the piston from slanting inside of the tank and becoming stuck in the tank. For example, if the diameter of the piston body is approximately 65 inches and the interior diameter of the tank is approximately 68 inches, the thickness of the anti-canting pads would have been approximately 1 ¼ inches.

Unfortunately, the use of pistons with anti-canting devices has numerous disadvantages. First, these pistons with large gaps between the tank wall and the piston impose greater stress and shear on the seals, because the seal has to extend far beyond the piston periphery to contact the tank wall. Second, most anticanting devices are static and cannot automatically compensate for the various dynamic forces that occur inside of the tank during the dispensing process. Another disadvantage is the added cost and complexity of manufacturing attributed to the manufacture and assembly of the anti-canting devices. Therefore, there is a need for a piston that avoids the disadvantages attributed to anti-canting devices, and can efficiently dispense practically all of the commodity material from a container while maintaining a tight seal without canting during the dispensing process.

SUMMARY OF THE INVENTION

Accordingly, the present invention is directed to a dispensing wiping piston that is simple, cost effective, environmentally safe and avoids the disadvantages of prior devices. In one aspect, the invention is directed to a piston for dispensing material from a commodity container, where the piston includes a nose section, a piston member behind the nose section, a recessed channel between the nose section and piston member, a wiping seal in the channel and a seal lifter placed in the channel behind the seal to force the seal outward to come into sealing contact with an interior wall of a commodity container. In a preferred embodiment, the seal lifter is an inflatable tube, similar to a bicycle inner tube.

In another aspect, the invention is directed to dispensing piston having an articulating piston shaft. The piston shaft is composed of tapered sections connected together with a resilient gasket between each section. Each tapered section has a maximum outside diameter adapted for close proximity to a tank wall. The resilient gasket allows each section to independently articulate to accommodate irregularities and bends in the container wall.

In still another aspect, the invention is directed to a piston having a load bearing wiping seal. The wiping seal is located within a recessed channel between a nose section and a piston shaft. The wiping seal has a broad groove in the wiping edge into which low friction material is placed. This material bears the load, reduces shear and stiffens the leading edge and trailing edge of the wiping seal on either side of the groove to maintain a tight seal against the container wall.

The invention may be used in any size container where the interior surface diameter of the tank is relatively consistent throughout the tank. The tank sizes can be as small as 55 gallons, or as large as several thousands of gallons. The tank orientation can be vertical, horizontal or tilted at an angle. Further advantages of the present invention will be apparent from the accompanying drawings and the detailed description of the invention.

DETAILED DESCRIPTION OF THE PREFERRED EMBODIMENTS OF THE INVENTION

The present invention is directed to a dispensing piston for use in cylindrical commodity containers. When the containers are perfectly round and do not have to flex, then a dispensing piston can be made to close dimensional tolerances to the interior surface of the tank wall. The close tolerances mean that canting is not even a consideration in the function and operation of the piston during the filling and dispensing process. For example, if the diameter of the tank is 44 ⅛ inches, the piston diameter is 43 ⅞ inches. This means that there is only ⅛ inch between the tank wall and the piston shaft around the whole perimeter of the tank. Because dispensing pistons with such close tolerance to the tank wall cannot cant, provided the shafts are sufficiently long, anti-canting pads or other methods to prevent canting are no longer needed.

Figure 1:
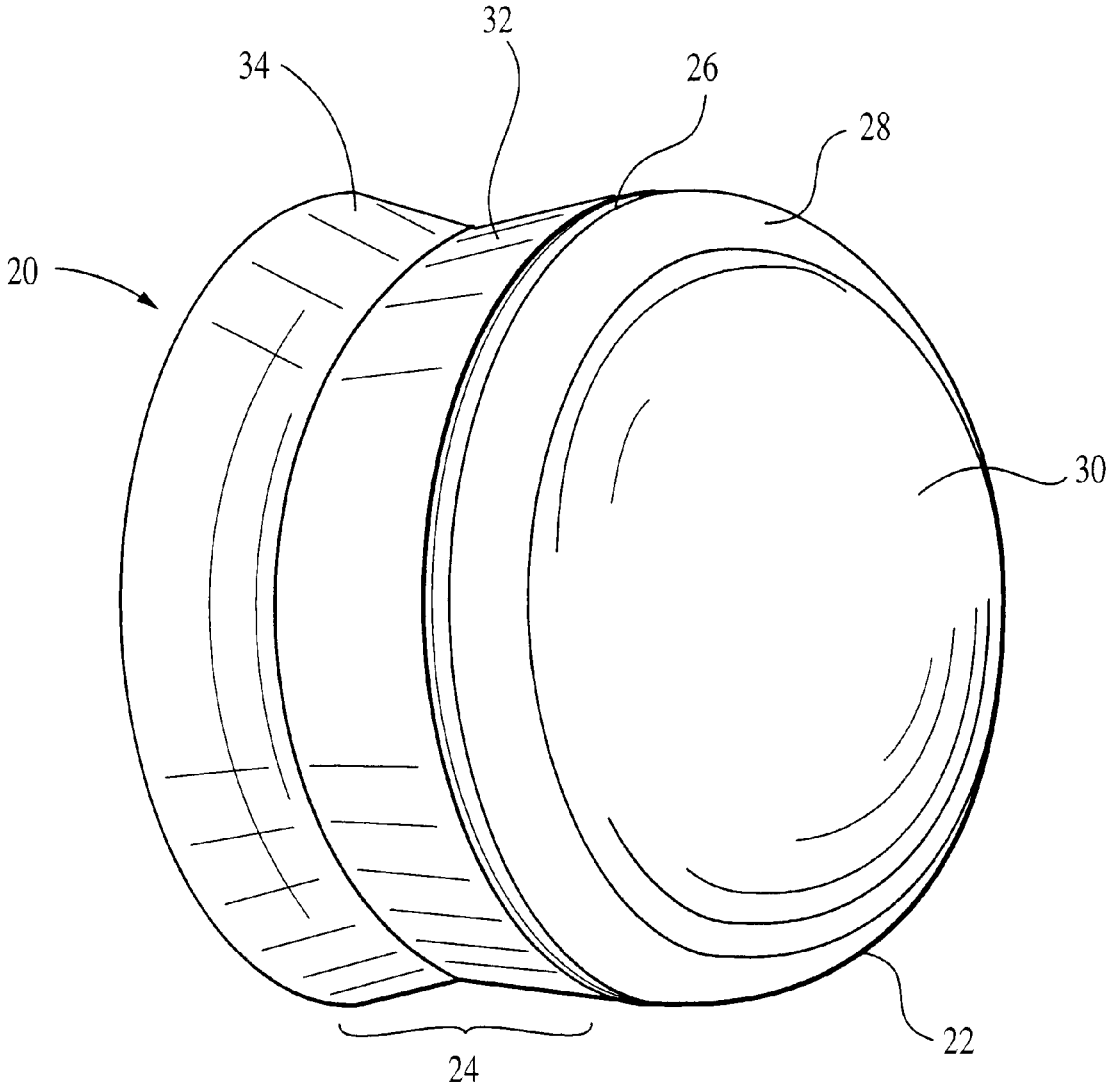
FIG. 1 is a perspective view of one embodiment of a dispensing piston of the present invention.

Accordingly, the present invention is directed to a dispensing wiping piston without anti-canting devices. One preferred embodiment of the present invention is depicted in FIG. 1. There is shown a perspective view of a piston 20 having a nose section 22, a piston shaft 24 and a wiping seal 26 located between the nose section and piston shaft. The nose section 22 includes a peripheral ring 28 and a compressible central nose surface 30. The central nose surface makes up the majority of the surface of the nose section. The piston shaft 24 includes two shaft segments 32 and 34, each having a tapered outer profile and sized so that the greatest diameter of each segment is about the same diameter as the outer diameter of the nose section. The wiping seal 26 is sized to extend beyond the piston diameter and contact a container wall.

Before describing the invention in further detail, the invention may be better understood in context with the commodity containers in which the invention is intended to operate. In that context, the piston may move in any direction depending on operation and orientation of the container in which it is placed. It should be understood, however, that to describe the piston herein, the direction towards the nose section is variously referred to as forward, leading, front, dispensing side, etc.; and the opposite direction towards the piston shaft is variously referred to as rearward, trailing, back, driving side, etc.

Figure 2:
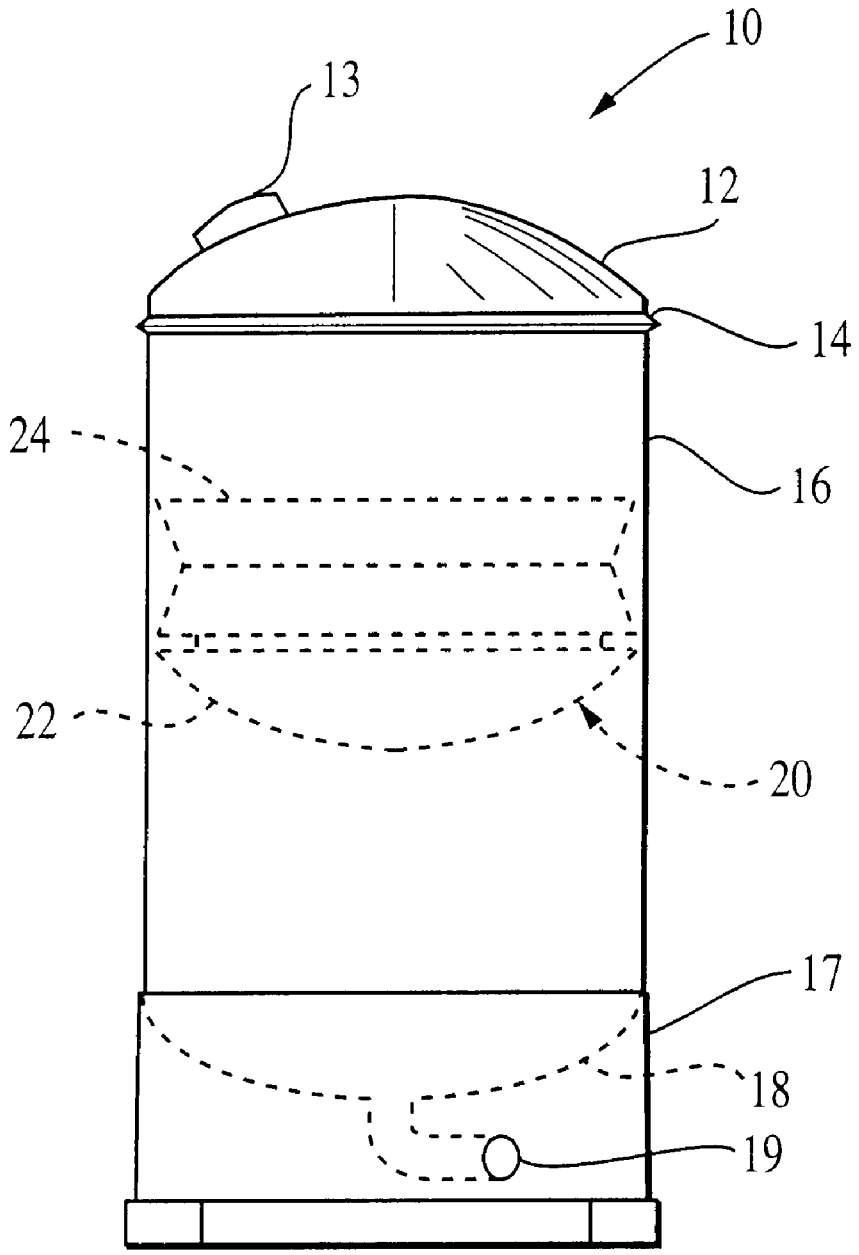
FIG. 2 is a side elevation of a vertically oriented commodity container showing inside the piston of FIG. 1.

To illustrate the present invention, FIG. 2 depicts a piston 20 inside a cylindrical commodity container 10 having a vertical orientation. This container 10 includes a lid 12, a body section 16, a lid-body flange connection 14, a bottom head 18, a base skirt 17, and a material outlet nozzle 19. Such containers are described in U.S. Pat. No. 5,887,750 to Popp et al., entitled "Commodity Container," which is herein incorporated by reference.

Inside of the container 10, there is one embodiment of a piston 20 in accordance with the present invention. The piston is depicted in more detail in FIG. 1, and is described in more detail later. However, in brief, the piston 20 includes a nose section 22 connected to a piston shaft 24. The nose section has a convex shape that complements and fits to the shape of the concave bottom head 18 of the container. In operation, the lid 12 of the container is opened up, the piston 20 is placed inside the container and the lid is resealed. The nose section 22 side of the piston faces downward towards the bottom of the container.

Commodity material is pumped into the container through the outlet nozzle 19, and pushes up against the nose section 22. When it is desired to dispense the commodity material from the container, a gas pressure is applied behind the piston shaft 24 to push the piston down against the material in the container, and push the material out through outlet nozzle 19. A sight glass 13 may be provided in the container lid 12 to allow an operator to visually inspect the interior of the container to verify correct operation of the piston 20 and/or to verify that the container walls are being wiped clean by the piston wiping seal. In this manner, an operator may be made aware that corrective action may need to be taken.

Figure 3:
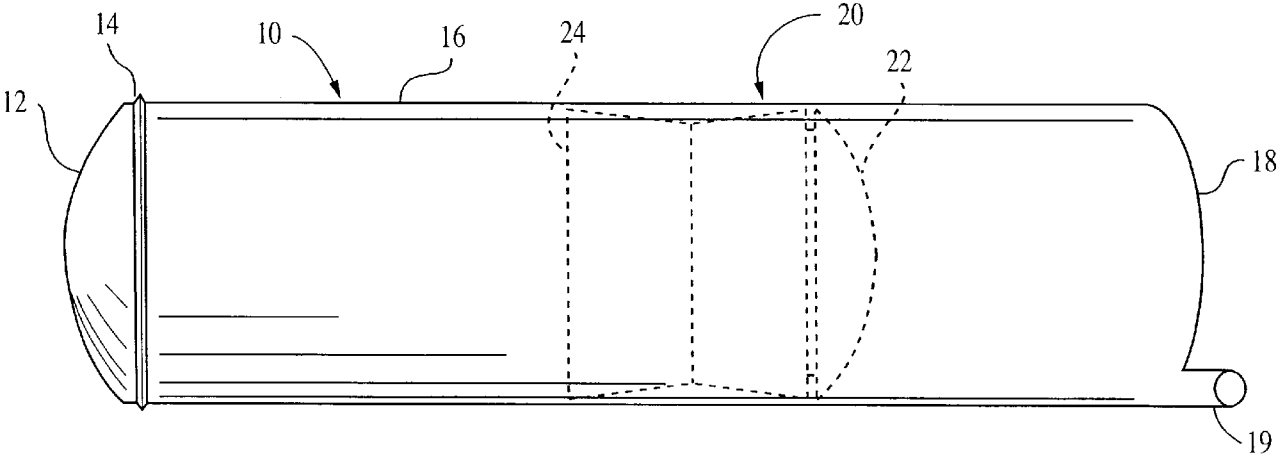
FIG. 3 is a side elevation of a horizontally-oriented commodity container showing a second embodiment of a piston.
Figure 4:
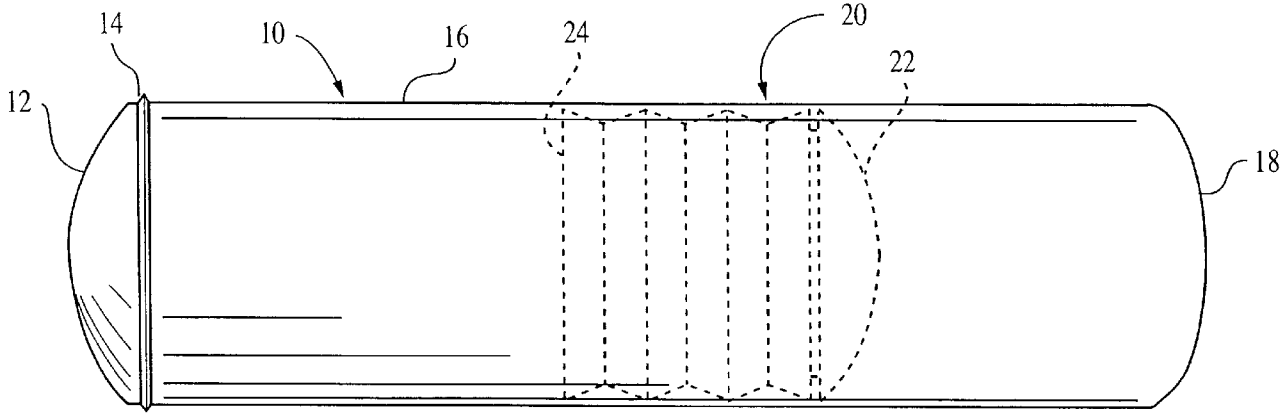
FIG. 4 is a side elevation of a horizontally-oriented commodity container showing a third embodiment of a piston.

FIGS. 3 and 4 depict elongated horizontal commodity containers. These containers 10 each have an end dish head 12 that opens the full diameter of the tank at flange 14 to allow direct placement of the piston 20 inside of the container. The piston 20 has a nose section 22 with a surface shaped to fit the opposite end 18 of the container near the outlet 19. FIG. 3 shows a second embodiment of the piston 20 with a piston shaft 24 composed of two extra-long separate tapered sections having outside diameters large enough to fit closely to the container walls 16. FIG. 4 shows a third another embodiment of the piston 20 having a piston shaft 24 of similar length as the shaft depicted in FIG. 3, yet the shaft of FIG. 4 is comprised of six separate shorter tapered piston shaft sections. The advantages of using these embodiments for the horizontally-oriented containers will be evident by the detailed description of the features of the present invention as discussed below.

Figure 5:
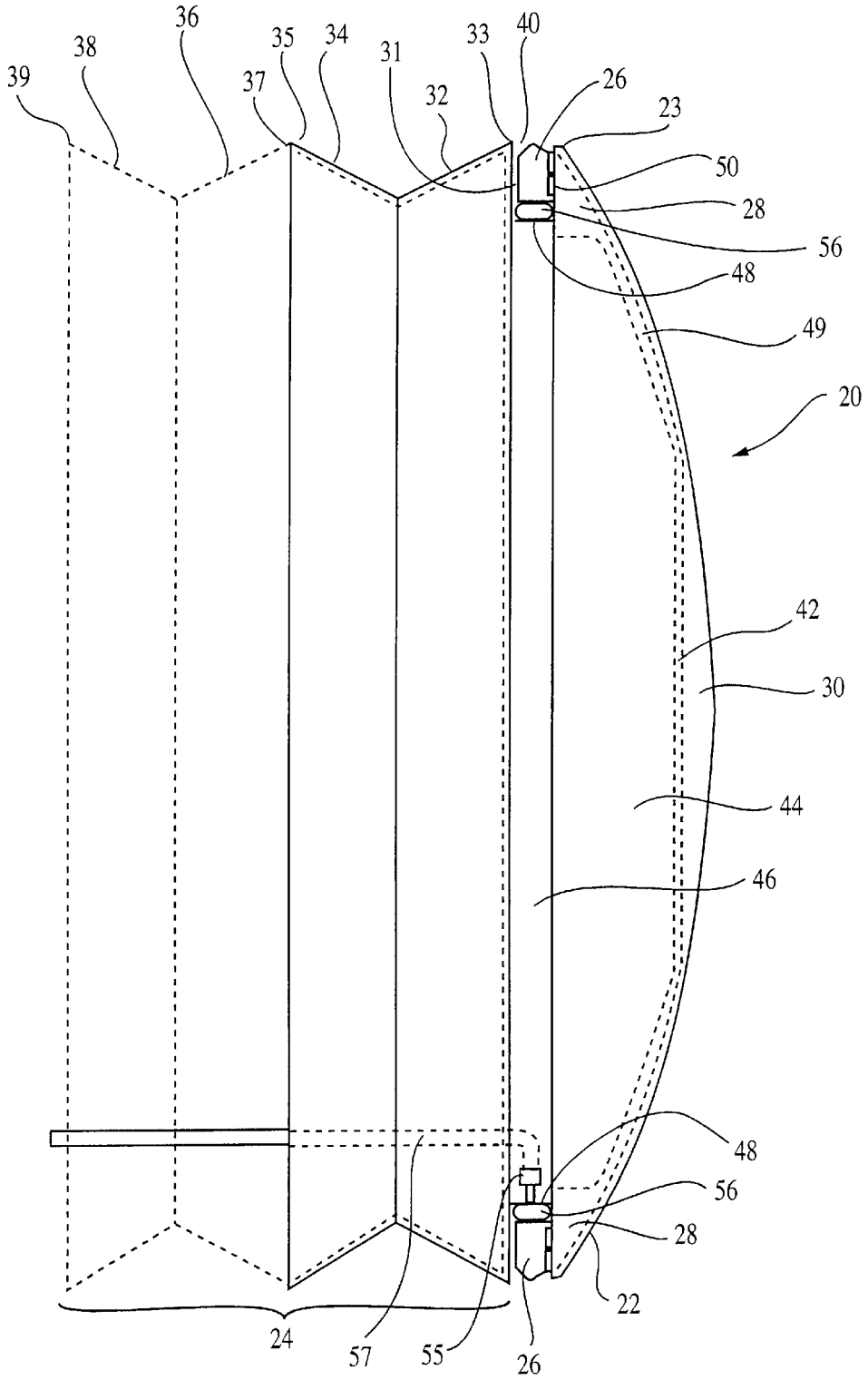
FIG. 5 is a side elevation of the piston of FIG. 1.

Referring now to FIG. 5, the piston 20 of FIG. 1 is shown in more detail with optionally added piston shaft segments. The piston 20 includes a nose section 22, a recessed seal channel 40, a wiping seal 26 and a piston shaft 24.

The nose section 22 has a convex shape to fit the bottom or end of the container where the material is being dispensed from the container. The nose can be made of one or more of at least the following products: polyurethane, urethane, urethane foam, rubber, plastic and/or any metal. The nose section 22 is preferably made from a composite of three materials. The surface 30 of the nose section is preferably made of a soft compressible polyurethane rubber type of material, preferably with a 40A durometer hardness. The nose section frame 42 is made from a rigid material such as high-density polyurethane or other type of rigid plastic to provide the structural rigidity for the nose section and may have stiffening ribs 49 in the frame for added strength. At a minimum, the nose frame 42 should include the peripheral ring 28 of the nose section. Typically, the nose section 22 has a generally hollow dish shape made by casting into the bottom dish head of the container. It is preferred that the back end or core 44, of the nose section be filled with a light weight filler such as a high density polyurethane foam. The outside peripheral edge 23 of the nose section 22 has a circular shape to fit the circular cross-section of a cylindrical container. The peripheral edge 23 of the nose section is sized to come into close proximity with the interior of a container wall within which the piston is used. The back plate 46 of the nose section 22 has a smaller diameter than the diameter at the peripheral edge 23. The smaller diameter of the back plate 46 provides the bottom 48 of a recessed channel 40 that extends around the circumference of the piston to provide a channel for the placement of a wiping seal 26 therein.

This recessed channel is preferably defined by a back side 50 of the nose section core and the forward side 31 of the piston shaft 24. The outer limit of the recessed seal channel 40 is defined by the gap between the peripheral edge 23 of the nose section and the leading peripheral edge 33 of the piston shaft. The recessed seal channel 40 is relatively deep for placement of the wiping seal 26. This channel extends continuously around the piston 20 and is recessed behind the piston nose section 22. Alternatively, the recessed channel may be separately constructed and attached behind the nose section. The side walls of the recessed channel should not extend beyond the periphery of the piston shaft or nose section. The material for the recessed channel can be polyurethane, urethane, plastic, or any type of metal.

Figure 6:
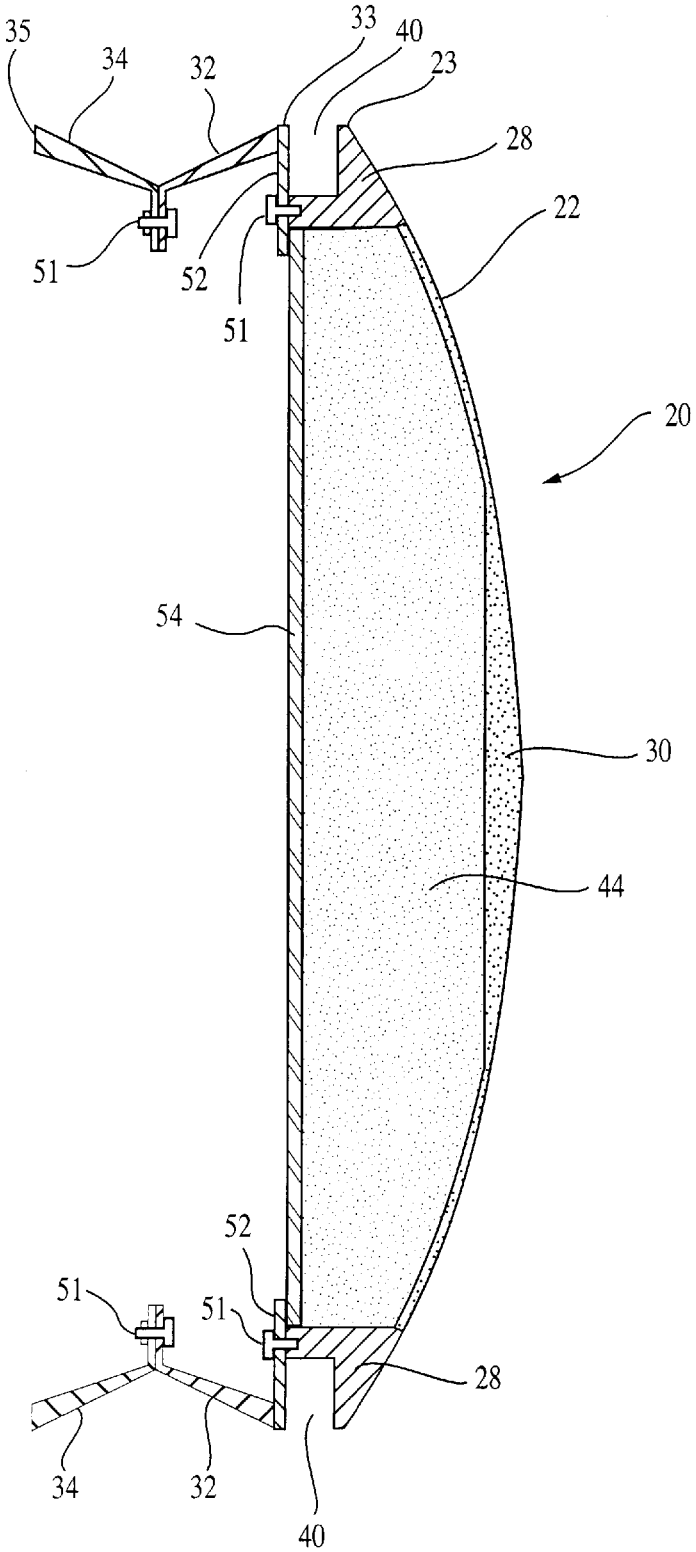
FIG. 6 is a cross-sectional view of the piston of FIG. 5 without a seal.

The piston 20 of FIG. 1 is also shown in cross-sectional detail in FIG. 6. This view is shown without a wiping seal or seal lifters in the recessed channel 40. The nose section 22 includes a peripheral ring 28, channel back ring 52 made of a rigid hybrid polyurethane, a nose surface 30 made from urethane rubber, and a back plate 54 made from plywood. The peripheral ring 28 has a leading surface contoured to fit the shape of the bottom head of the container. Opposite the leading surface, a cast or cut-out groove in the peripheral ring provides a side and bottom surface for the recessed channel 40. A channel back ring 52 fits against the backside of the peripheral ring 28 to form the back side of the recessed channel. The nose surface 30 provides the nose section with a compressible surface inside of the peripheral ring 28. The nose surface 30 has more thickness at the axial center of the nose section. The core 44 fills the center of the nose section with a light weight rigid material. The core back plate 54 caps off and seals the back side of the core 44.

The peripheral edges 33 and 35 of the piston shaft segments 32 and 34, respectively, preferably have the same outside diameter, which is also the same as the outside diameter of the peripheral edge 23 of the nose section. The edges are machined separately, or together, to have a close tolerance to the interior wall of a container in which that piston will be used.

The piston may be held together by bolts, glue, and any suitable combination of fastening materials. Preferably, the piston shaft sections 32 and 34 are fastened together with bolts 51 and then bolted to the channel back ring 52, which in turn is bolted to the nose section peripheral ring 28. By using bolts, the piston shaft and channel back section may be disassembled to open the recessed channel while the piston is inside a container. After the recessed channel is opened, the wiping seal or seal lifter may be replaced.

Figure 11:
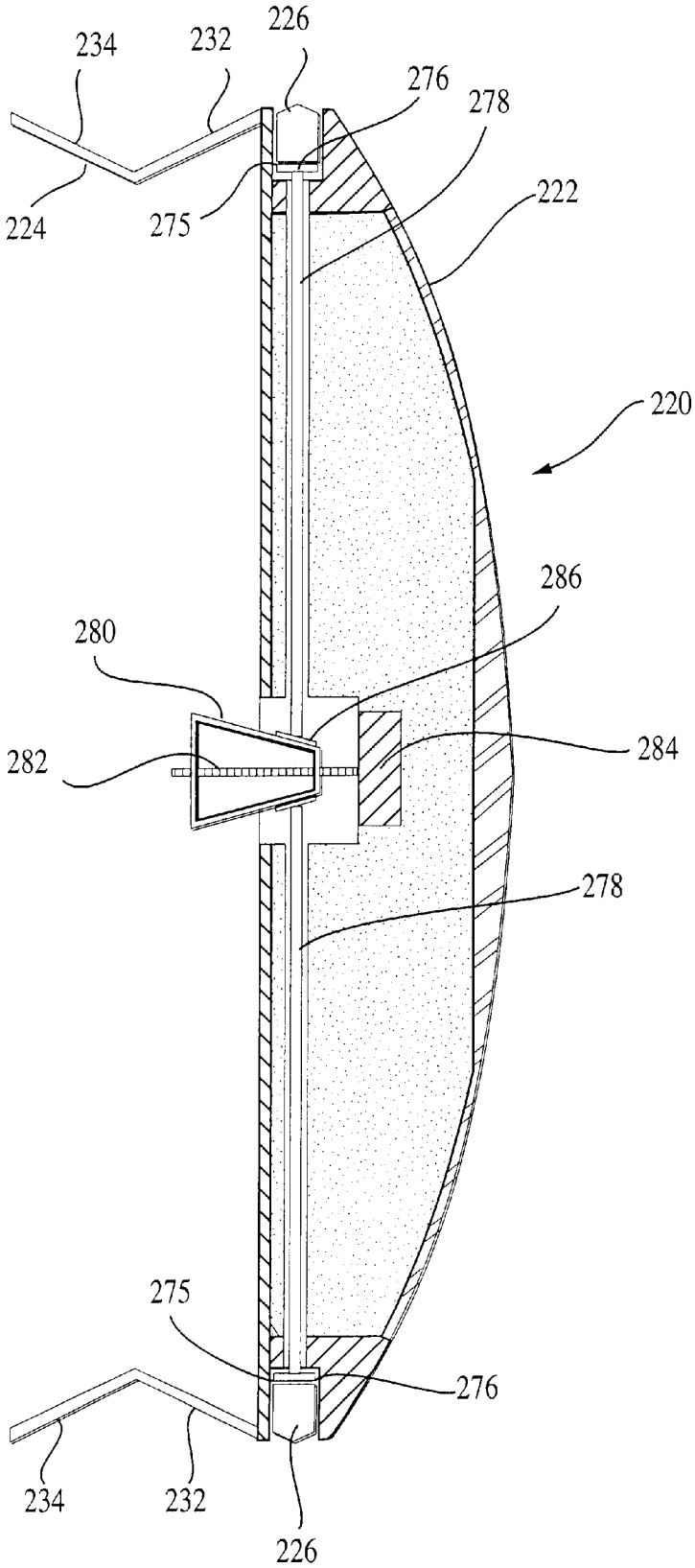
FIG. 11 is a cross-sectional view of a fifth embodiment of a piston.

Typically, for a container with a 44 inch diameter, the recessed channel for the solid wiping seal is preferably about 2 ½ inches deep. This channel depth keeps the seal lifters (such as the inflatable tube 56, as shown in FIG. 5, or mechanical lifter segments 276, as shown in FIG. 11) that press the solid wiping seal against the tank wall from being exposed to the material being dispensed from the tank. Very little of the expandable solid wiping seal is extended beyond the edges of the deep recessed channel because of the piston's close tolerance to the tank wall diameter. Furthermore, the expandable solid wiping seal is firmly held in place and can not roll out because of the depth and tight tolerances of the recessed channel holding the seal. These close tolerances prevent roll-over blow-out of the wiping seal. The depth of the recessed channel and the tight tolerances also laterally reinforce the expandable solid wiping seal to resist the forces caused by heavy or viscous commodity materials.

Figure 12:
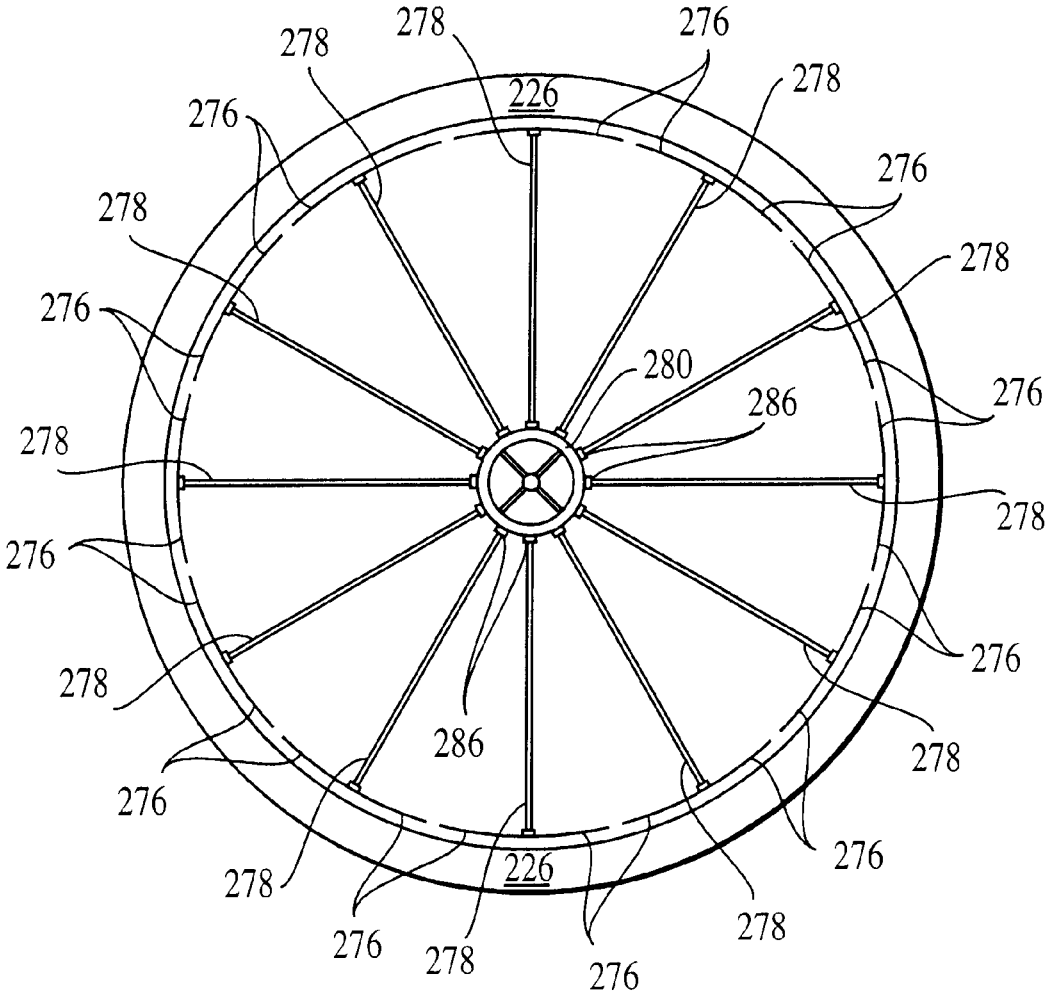
FIG. 12 is a top plan view of the seal expander spokes and cam assembly across line 12'–12' of FIG. 11.

Referring back to FIG. 5, the wiping seal 26 is placed in the recessed channel 40 and extends continuously around the piston. The wiping seal is made from a solid resilient material that is stretchable, such as, but not limited to, Buna, EPDM, neoprene, Viton®, or other expandable materials. The solid wiping seal 26 is extended out of the recessed channel towards the tank walls by using a seal lifter 56. Preferably, the seal lifter may be an inflatable tube 56, such as a bicycle tube (for example, a thorn proof EPDM bicycle tube), to pneumatically push the wiping seal out towards the container wall. (Also, the seal can be mechanically pushed out towards the sides of the tank wall with circular metal segments 276, as shown in FIGS. 11 and 12.) The inflatable tube 56 may also be filled with a liquid instead of a gas. The liquid can be water, glycol, or any other type fluid. The advantage of using a liquid instead of a gas is that water-based liquids are not compressible. Therefore, more even and firm pressure can be exerted against the solid expandable wiping seal. This is important when wiping materials from a tank wall that are highly viscous, firm and/or sticky. The inner tube 56 has an inflation nozzle 55 that is connected to a flexible air hose 57 that connects to a remote inflation nozzle (not shown) passing through the container wall at one end of the container. Through this remote nozzle, the inner tube 56 may be inflated or deflated after the container is sealed. A pressure gauge may be connected to that remote nozzle on the outside of the container to monitor the inner tube pressure.

The piston shaft 24 is located behind the nose section 22. The piston shaft has a leading peripheral edge 33 with an outside diameter that preferably approximates the outside diameter of the nose section 22. The piston shaft may optionally be composed of an increased number of tapered segments. Rear piston shaft segments 36 and 38 may be added to the forward piston shaft segments 32 and 34 obtain the desired length for the piston shaft 24. However, it is preferred that each individual tapered segment have an outer peripheral edge 33, 35, 37 and 39, that is sized to come into close proximity with the interior container wall. By close proximity, it is meant that the edge of the piston should come to within about ⅛ inch (about 3 to 4 mm) of the container wall. To achieve a close tolerance, that is, a close fit to a container interior wall, the outer peripheral edge of each piston segment should be machined to a dimension matching the container in which it is intended to be used. Alternatively, the piston segments and nose section peripheral edges may be simultaneously machined after the nose section is assembled.

Accordingly, the piston shaft is preferably made from a rigid plastic that is easily machined, and has some flexibility. Some other advantages of using a flexible plastic piston shaft is that it will not gouge or score a tank wall, and will not lock-up should it get lodged in a portion of the tank wall that later gets slightly out of round.

Figure 7:
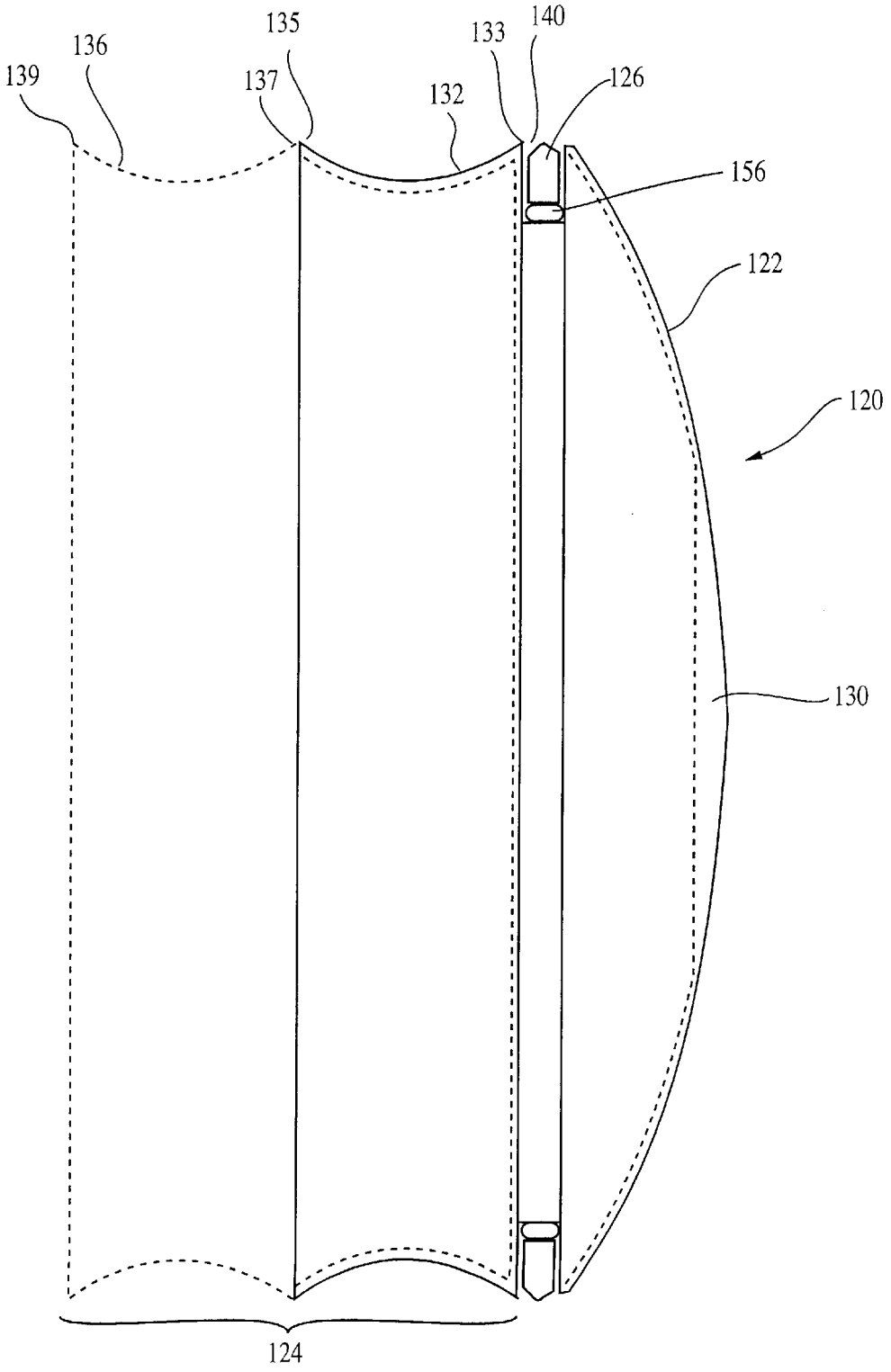
FIG. 7 is a side elevation of a fourth embodiment of a piston.

Referring now to FIG. 7, there is shown a fourth embodiment of a piston 120 in accordance with the present invention. In this embodiment, the nose section 122, wiping seal 126 and seal lifter 156 configurations are similar to the corresponding elements shown in FIG. 5. However, the piston shaft 124 is made up of differently shaped shaft segments 132 and 136. The shaft segments 132 and 136 have an inverted scalloped curve shape in cross section. The leading peripheral edge 133 at the largest diameter is sized to be in close proximity to the interior of a container wall. The remaining side surface of the piston shaft segment, being scalloped, then curves away from the tank wall and curves back again to come into close proximity with the tank wall at the opposite side of the shaft segment 135. Preferably, each of the outer peripheral edges 133, 135, 137 and 139 have the same diameter.

As may be appreciated by one skilled in the art, the piston shaft 124 may be composed of piston segments having any cross-section, but preferably having a varying outside diameter. More preferably, the piston segments have a cross section with shapes such as trapezoids (e.g., tapered outer profile as in FIG. 5), or inverted scalloped curves 40, 41 (e.g., scalloped outer profile as in FIG. 7) that have a continuously varying outside diameter. The shaft is manufactured so that there is minimal dimensional difference between the inside diameter of the tank and the largest outer diameter of the piston shaft edges (a close tolerance piston shaft). The purpose of these preferred shapes is to provide the minimum amount of piston shaft surface contact to the tank wall to reduce friction against the tank wall, and to provide a counter-balance to the piston nose when the piston is used in a horizontal tank or vertical tank. This means that the pressure used to push the piston through the tank goes directly to pushing the material out of the tank and not to overcoming friction between the tank wall and the piston shaft.

Any number of piston shaft tapered or curved segments may be ganged together to make a piston shaft with a length and weight desired for a particular application depending on such factors as tank diameter, viscosity of the material being dispensed, the pressures required for dispensing, and horizontal dispensing versus vertical dispensing. In horizontal dispensing applications, the shaft may need to be elongated to counter-balance the weight of the piston nose. For example, in a horizontally oriented tank having a 44-inch diameter, a combined nose section and piston shaft length of 40 inches is desirable. In contrast, in a vertically oriented tank having a 44-inch diameter, a combined nose section and piston shaft length of 20 inches in desirable. As shown in FIGS. 5 and 7, the length of the piston shaft can be increased by preferably using multiple pairs of shaft segments. Likewise, as shown by comparison of FIGS. 3 and 4, the longer piston shaft may be obtained by using longer individual segments. However, it is preferred to use more segments, rather than longer segments, because more segments provide additional bearing points for the piston to di tribute the weight of the piston. The shaft may be made from any appropriate rigid material, such as polyurethane, urethane, plastic, or any type of metal.

Figure 8A:
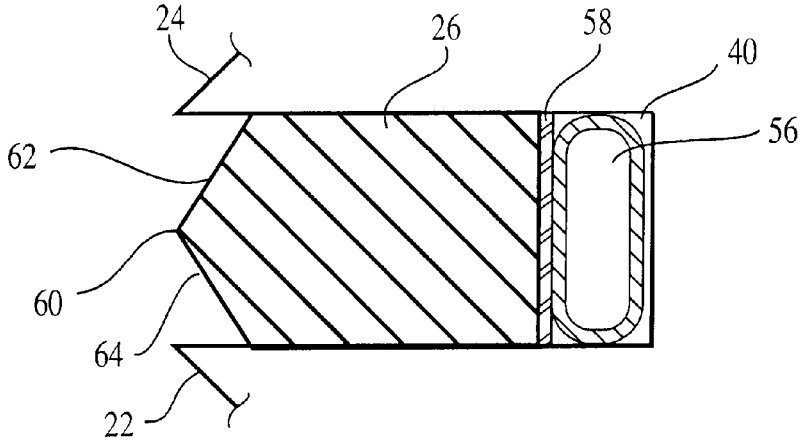
FIGS. 8*a, b*, and *c* are enlarged cross-sectional views of various embodiments of the wiping seal in the recessed channel of a piston.
Figure 8B:
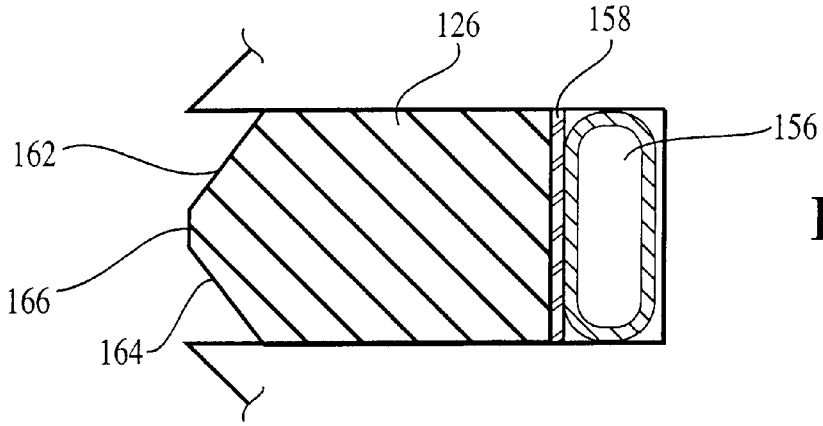
Figure 8C:
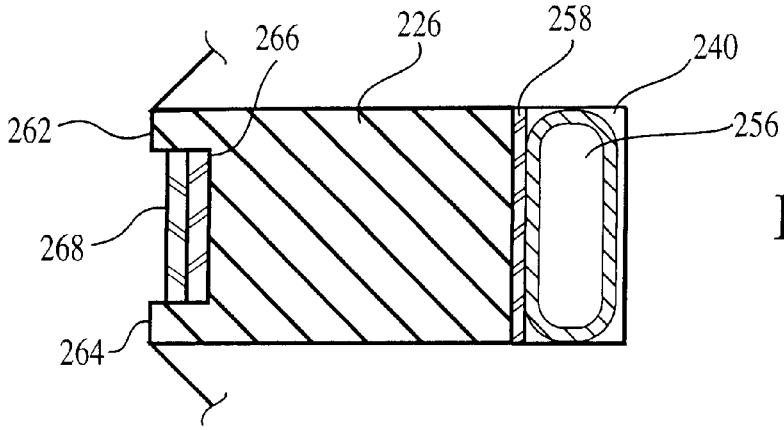

The wiping seal located within the recessed channel may have different features depending on the application. FIGS. 8*a*, 8*b*, and 8*c* depict three different embodiments of a wiping seal and seal lifter/expander. The wiping seal of FIG. 5 is shown in FIG. 8*a*. The seal lifter 56 is placed in the bottom, i.e., the most radially inward part, of the recessed channel 40, which as described above is between the nose section 22 and the piston shaft 24. It is preferred that the seal lifter 56 be an inflatable tube, such as a bicycle inner tube. Above the seal lifter 56, a strip of low friction material 58 is preferably placed on the lifter 56. Also, the strip of low friction material may be placed on the other side of the lifter, i.e., against the bottom of the channel. This strip, tape, or ribbon 58 may be made from nylon, Teflon, or other low-friction material. Around the ribbon 58, there is the wiping seal 26. In the embodiment shown in FIG. 8*a*, the active end of the wiping seal comes to a thin wiping edge 60 defined by the intersection of a trailing surface 62 and a leading surface 64. The thin wiping edge 60 provides a vary narrow surface to concentrate the forces applied by the seal lifter 56 forcing the seal against the container wall, thereby providing strong wiping action against the container wall. The strong wiping action keeps the container wall clean of commodity material, so that the wall does not get "gummed-up" with material that may cure, dry or degrade upon exposure to the gas behind the piston.

The Teflon ribbon 58 is placed around the circumference of the piston between the inflatable tube 56 (or the circular metal segments 276) and the solid wiping seal 26, to reduce the friction between the inflatable tube (or circular metal segments) and the solid wiping seal. By reducing the friction, the solid wiping seal 26 can evenly be expanded around the circumference of the piston to provide 360-degree uniform pressure against the tank wall. Otherwise, there could be areas of contact between the inflatable tube (or the circular metal segments) and the solid wiping seal that restrain the even expansion of the inflatable tube and extension solid wiping seal out of the recessed channel and against the container wall.

FIG. 8*b* depicts a second embodiment of the wiping seal 126. In this embodiment, the seal lifter 156 and low-friction ribbon 158 are similar to the embodiment shown in FIG. 8*a*. However, the wiping end of the wiping seal is different. The trailing and leading surfaces 162 and 164 do not directly intersect, but are separated by a narrow wiping surface 166 that contacts the tank wall.

FIG. 8*c* depicts a third embodiment of the wiping seal 226. In this embodiment the seal lifter 256 and low-friction ribbon 258 are similar as described above. Likewise, the wiping end of the wiping seal 226 extends beyond the end of the recessed channel 240, but now with a trailing lip 262 and a leading lip 264. Between these two lips, there is a groove 266 cut into the wiping seal 226. Within this groove 266, there is a bearing ring 268. The bearing ring 268 is made of a strip, or strips, of lubricous or low-friction material, such as nylon or Teflon. The bearing ring is designed to provide a low-friction bearing surface to absorb the bulk of the load from the seal lifter forcing the seal against the container wall. When the piston is used in a horizontally-oriented container, the bearing ribbon also absorbs the load due to gravity forcing the weight of the piston down on one side of the seal. Also, the bearing ring provides extra stiffness to the trailing lip 262 and leading lip 264 that provides a stiffer, more shear resistant wiping edge to seal the piston against the tank wall.

Figure 9A:
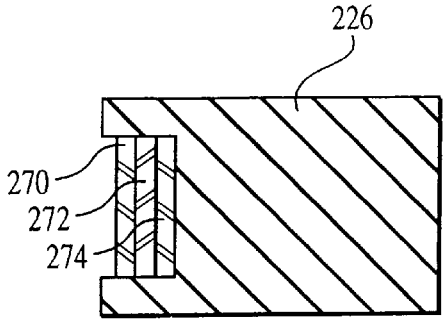
FIGS. 9*a, b*, and *c* are enlarged cross-sectional views of various embodiments of the wiping seal for vertically-oriented containers.
Figure 10A:
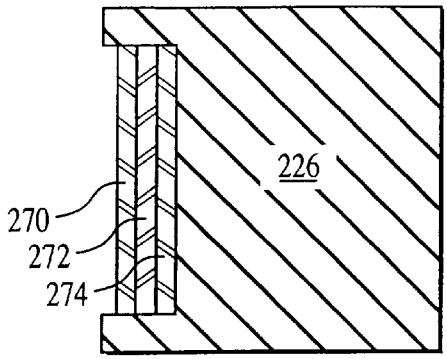
FIGS. 10*a, b*, and *c* are enlarged cross-sectional views of various embodiments of the wiping seal for horizontal containers.
Figure 9B:
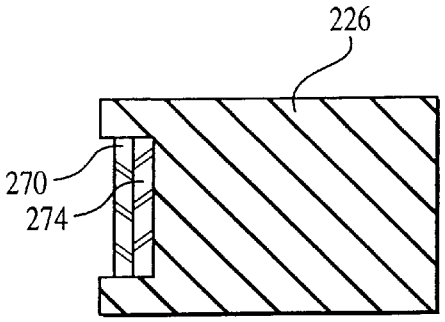
Figure 10B:
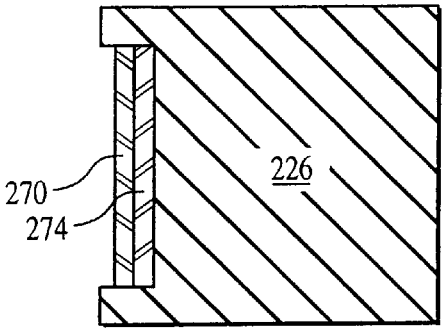
Figure 9C:
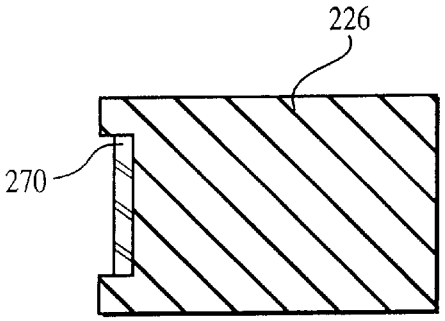
Figure 10C:
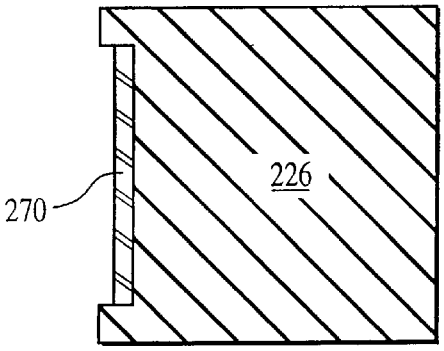

FIGS. 9*a*, 9*b*, 9*c* and 10*a*, 10*b* and 10*c* depict the detail of a wiping seal 226, such as the type depicted in FIG. 8*c* which includes a bearing ring 268. Depending on various load factors, it may be desired to use one top bearing ring 270, a top and bottom bearing ring 270 and 274, or a top, middle and bottom bearing ring 220, 272 and 274, such as shown in FIGS. 9*a*, 9*b* and 9*c*, respectively, or FIGS. 10*a*, 10*b* and 10*c*, respectively. The wiping seals in this configuration are believed to be effective for use in vertically-oriented tanks with a heavy viscous material contained therein. For heavy viscous materials, greater force is required on the wiping seal against the tank wall. Therefore, the wiping seal with the heavy-duty triple bearing ring is preferred in this application. For similar application in a horizontally-oriented container, it would be desired to use a seal that has a wider cross section to be able to handle greater loads due to the extra weight of the piston down on one side of the wiping seal. Accordingly, FIGS. 10*a*, 10*b* and 10*c* depict such wiping seals for use in horizontal containers. These wiping seals are depicted with one, two or three stacked bearing rings depending on the anticipated loads.

The low-friction bearing ring may offer several advantages. When the piston is used in a slanted or horizontal position, the nylon or Teflon bearing ring supports the weight of the piston nose end without providing friction or drag during the dispensing process. The bearing ring reduces wear to the expandable wiping seal by bearing most of the weight of the piston nose. The bearing ring also reinforces the wiping edges of the expandable solid wiping seal so that the edges do not "give" or fluctuate during the dispensing process.

In addition to selecting bearing ring configuration for optimum performance, the dimensions of the seal may be selected for optimum performance. The depth of the nylon or Teflon bearing can be adjusted to provide as much support to the wiping edge of the wiping seal as may be required for dispensing different types of products. The width of the solid wiping seal lips on each side of the nylon or Teflon bearing material can be adjusted for the type of material to be dispensed from the tank. Likewise, the durometer of the wiping seal can be adjusted depending on the type of material to be dispensed from the tank.

FIG. 11 depicts a fifth embodiment of a piston in accordance with the present invention. This piston 220 has a convex nose section 222, a wiping seal 226 and a piston shaft 224 made up of two tapered shaft segments 232 and 234. The piston 220 in FIG. 11 uses mechanical seal lifters 275. The mechanical seal lifter 275 includes a mechanical lifter segment 276 that is connected to a spoke 278, which at the opposite end 286 of the spoke slides against a cam 280. The cam 280 is threaded on a screw 282 fixed into a block 284 in a nose section 222. As the cam 280 is threaded down into the screw 282, the spokes 278 are pushed evenly outward due to the tapered shape of the cam. Simultaneously, the mechanical lifter segments 276 evenly push the wiping seal 226 outward against the container wall. The amount of pressure applied to the tank wall can be adjusted by turning the center cam 280, which preferably has a frusto-conical shape. Each spoke 278 may have a bearing pad 286 in sliding contact with the cam 280. As shown in FIG. 12, numerous arcuate mechanical lifter segments 276 are placed around the inner circumference of the wiping seal 226. Each lifting segment 276 is connected to a spoke 278 that has a bearing pad 286 that engages a center cam 280.

As noted above, the piston is sized for close tolerance to the container wall. Thus, it may be desirable to take steps to prevent irregularities in the container wall. For example, the outside of the container may be wrapped in a foam insulative material, and then covered with a protective layer of metal, such as galvanized expanded steel mesh. This protective coating may prevent dents and other irregularities in the wall due to accidental bumping during handling of the containers.

Figures 13, 14:
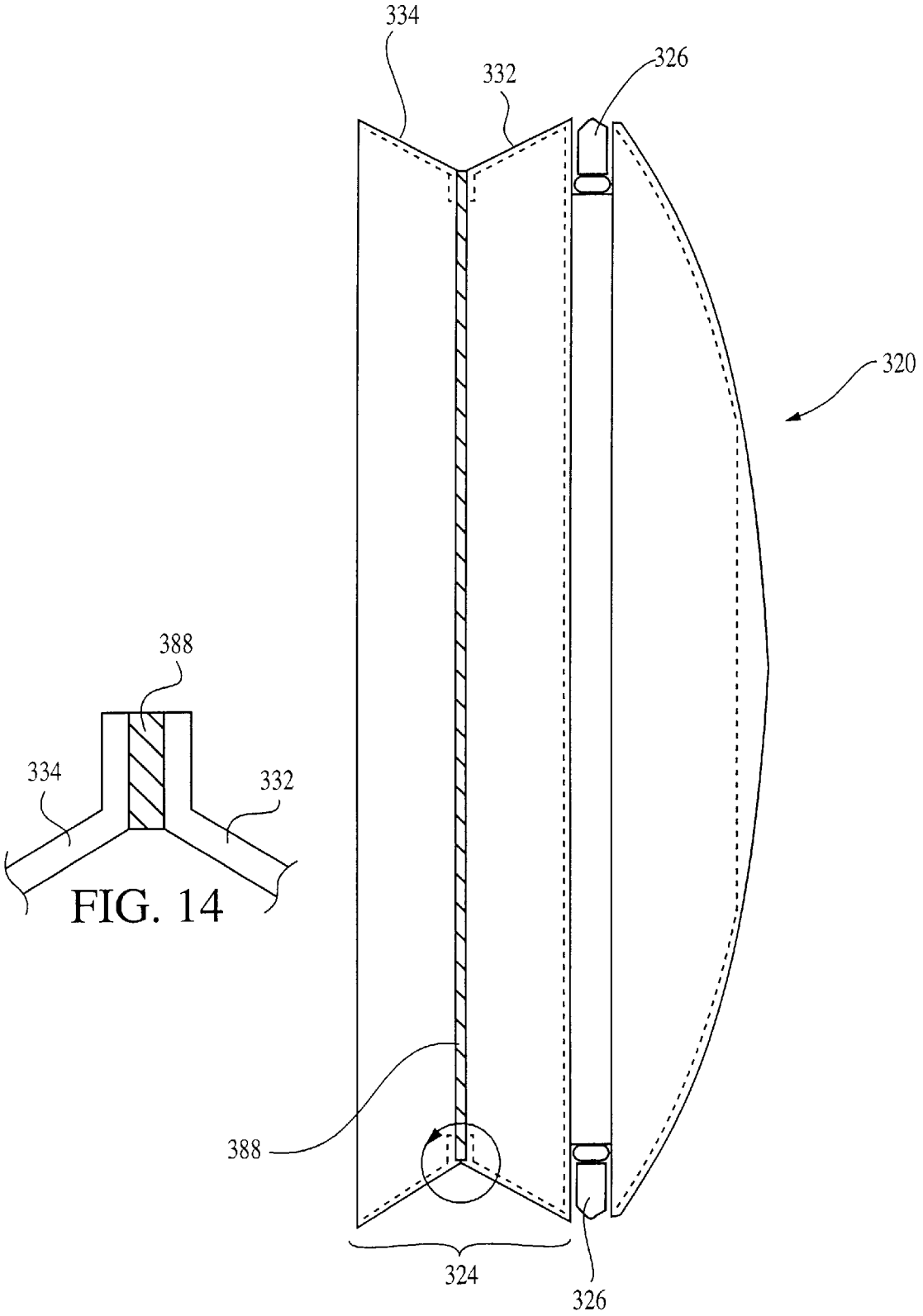
FIG. 13 is a side elevation of a sixth embodiment of a piston.
FIG. 14 is an enlarged cross-sectional view of details of the piston shaft gasket shown in FIG. 13.

In addition to preventing such irregularities, it may be desirable to accommodate slight irregularities in a container tank wall by incorporating some flexibility in the piston design. For example, besides making the piston out of semi-rigid materials that have some accommodating resilience, it may be desirable to provide the piston shaft with means for articulation. Accordingly, the present invention includes embodiments where a resilient material is placed between the individual piston shaft segments. Referring now to the sixth embodiment of a piston 320 depicted in FIG. 13, the piston shaft 324 is composed of two trapezoidal cross-section piston segments 332 and 334. Between these segments, there is a compressible gasket 388, which is shown in greater detail in FIG. 14. This compressible gasket allows piston shaft segment 334 to move somewhat slightly independent of piston shaft segment 332. The movement of the piston shaft segment 332 does not affect operation of the wiping seal 326. The gasket material may be Buna, EPDM, neoprene, Viton, or other compressible material.

Figure 15:
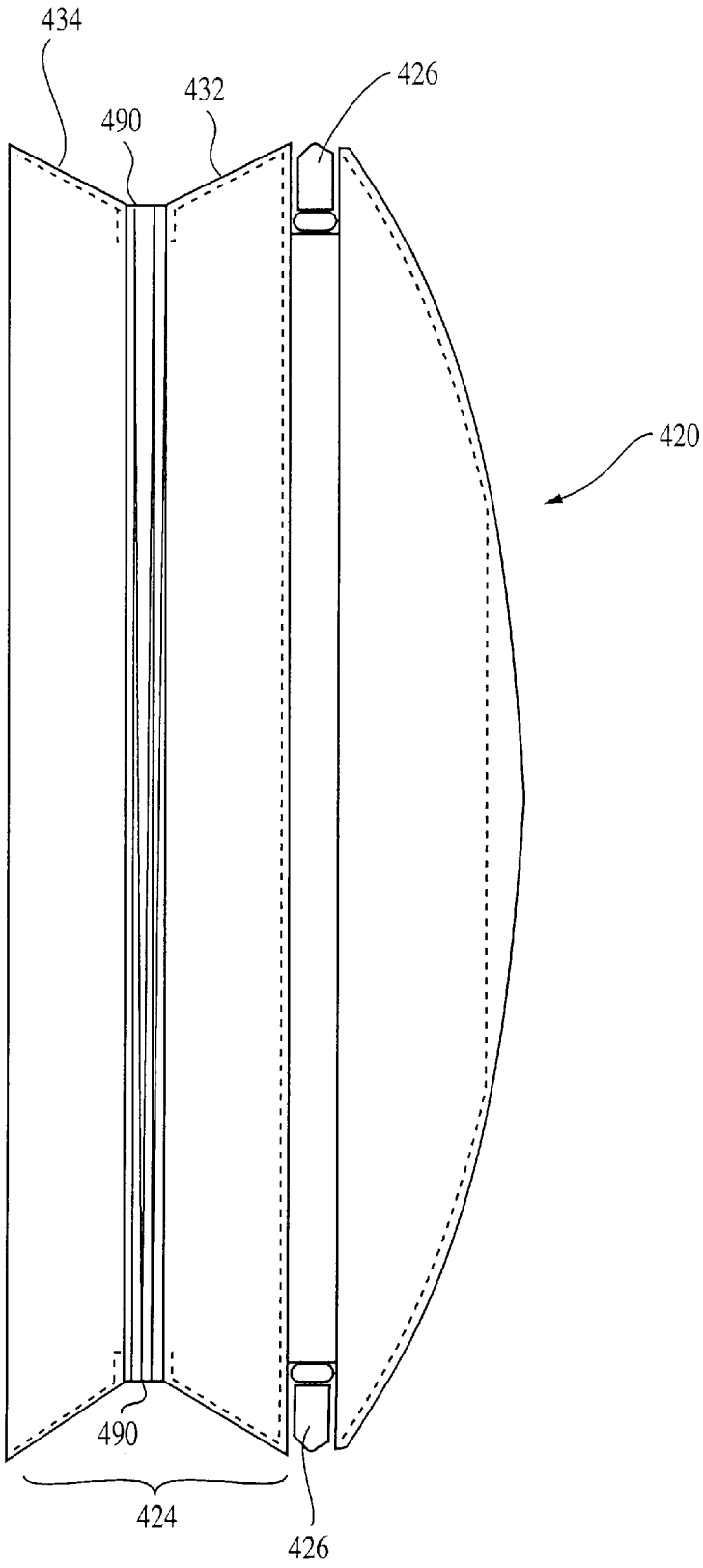
FIG. 15 is a side elevation of a seventh embodiment of a piston.

FIG. 15 shows a seventh embodiment of a piston 420 having an articulating piston shaft 424 made of two trapezoidal piston segments 432 and 434. Between these piston segments, a large diameter coil spring 490 having a diameter similar to the piston segments may be placed to provide means for the trailing piston segment 434 to articulate independently of the leading piston segment 432 without affecting operation of the wiping seal 426.

Figure 16:
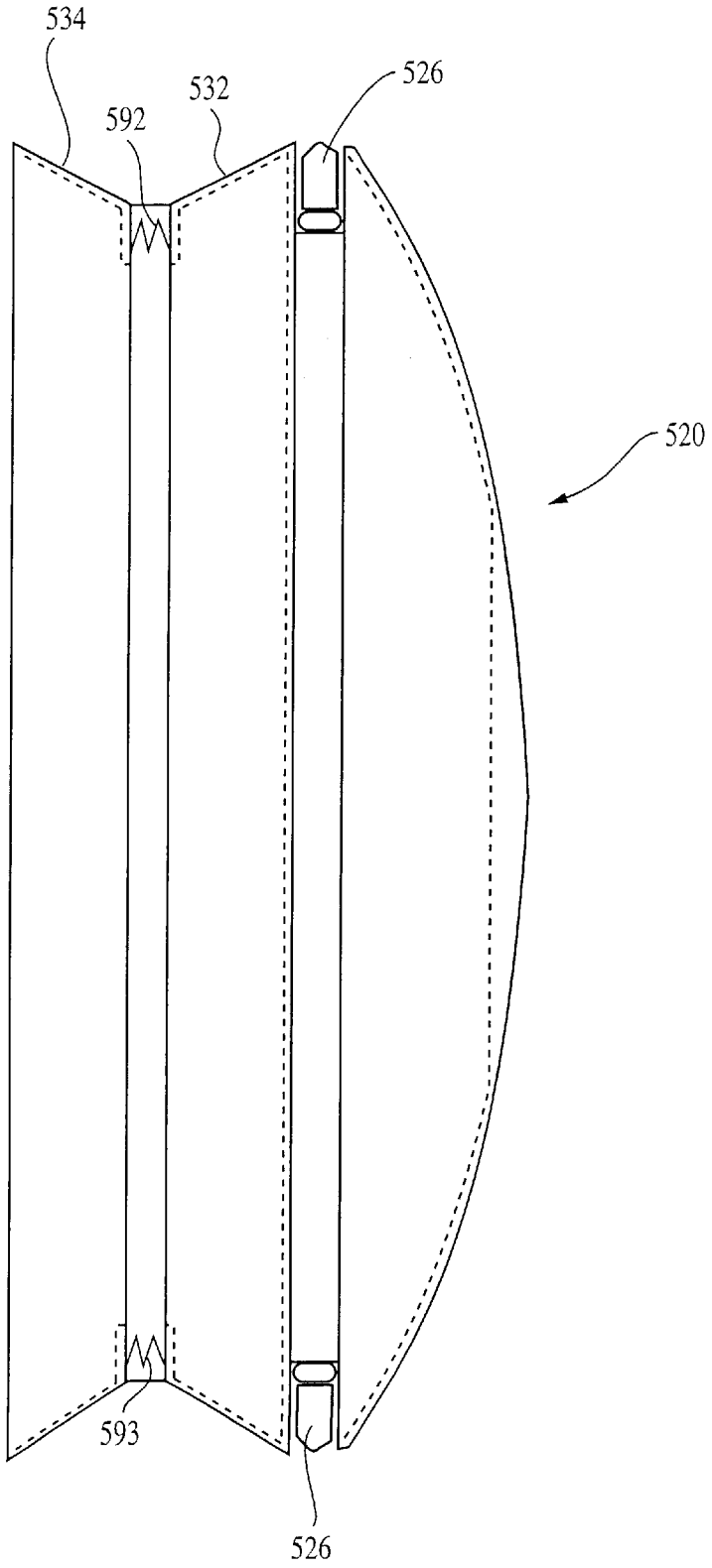
FIG. 16 is a side elevation of an eighth embodiment of a piston.

FIG. 16 depicts an eighth embodiment of a piston 520. In that embodiment, numerous small diameter coil springs 592 and 593 (others not shown) are evenly spaced around the smaller circumference of the trapezoidal piston shaft segments 532 and 534. These coiled springs 592 and 593 allow the trailing piston segment 534 to move somewhat independently of the leading piston segment 532 without affecting operation of the wiping seal 526.

Figure 17:
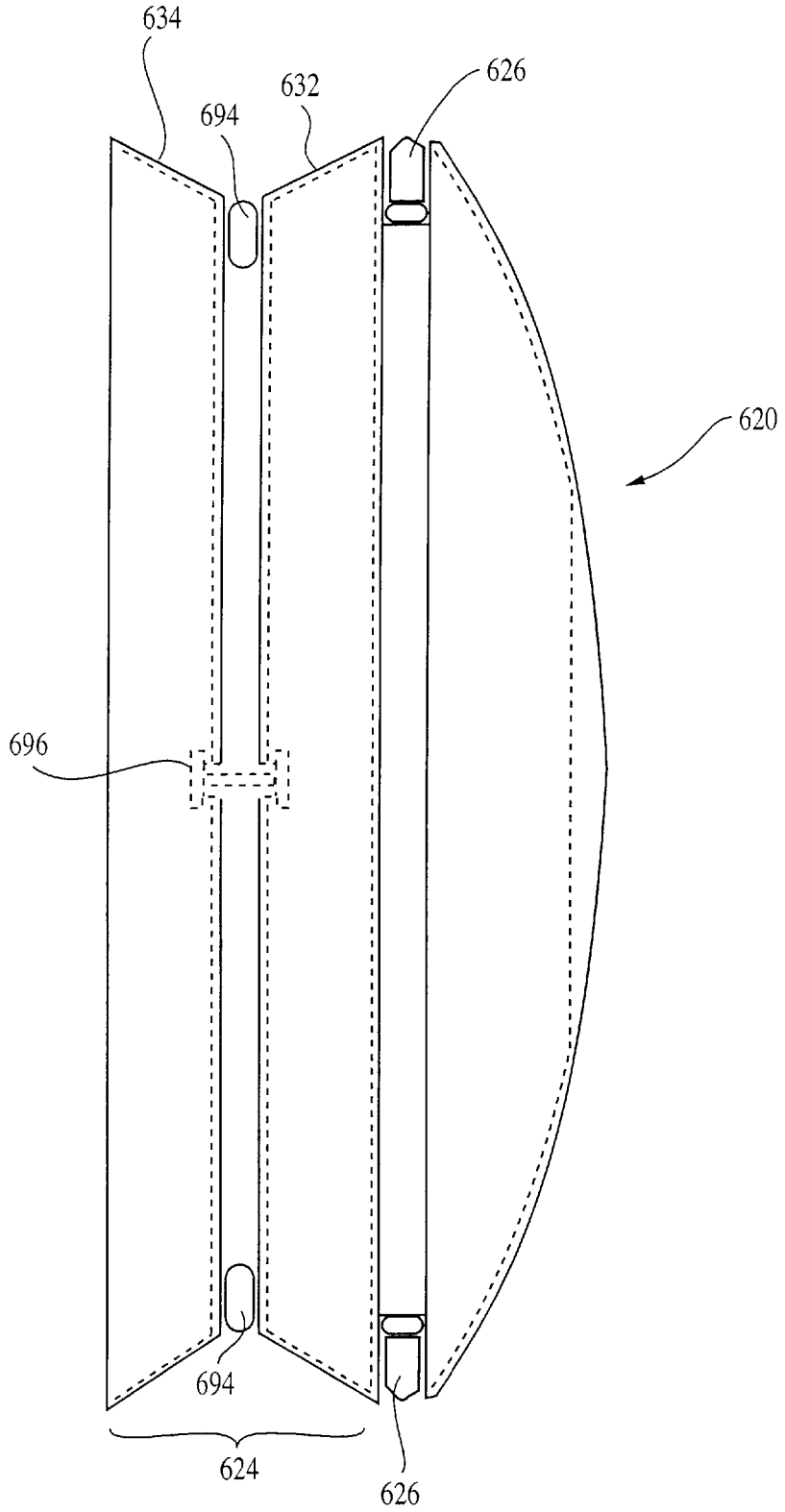
FIG. 17 is a side elevation of a ninth embodiment of a piston.

FIG. 17 depicts a ninth embodiment of a piston 620 with an articulating piston shaft 624 and standard wiping seal 626. In this embodiment, an inflatable O-ring seal 694, such as an inner tube, is placed around the joint between the two piston segments 632 and 634. A retainer clip 696 is provided centrally between the two segments to loosely keep them together. Yet, the inflatable O-ring 694 provides a dynamic counter-balancing force that allows the trailing piston segment 634 to move independently of the leading piston segment 632 within a small range limited by the fastener 696.

Figure 18:
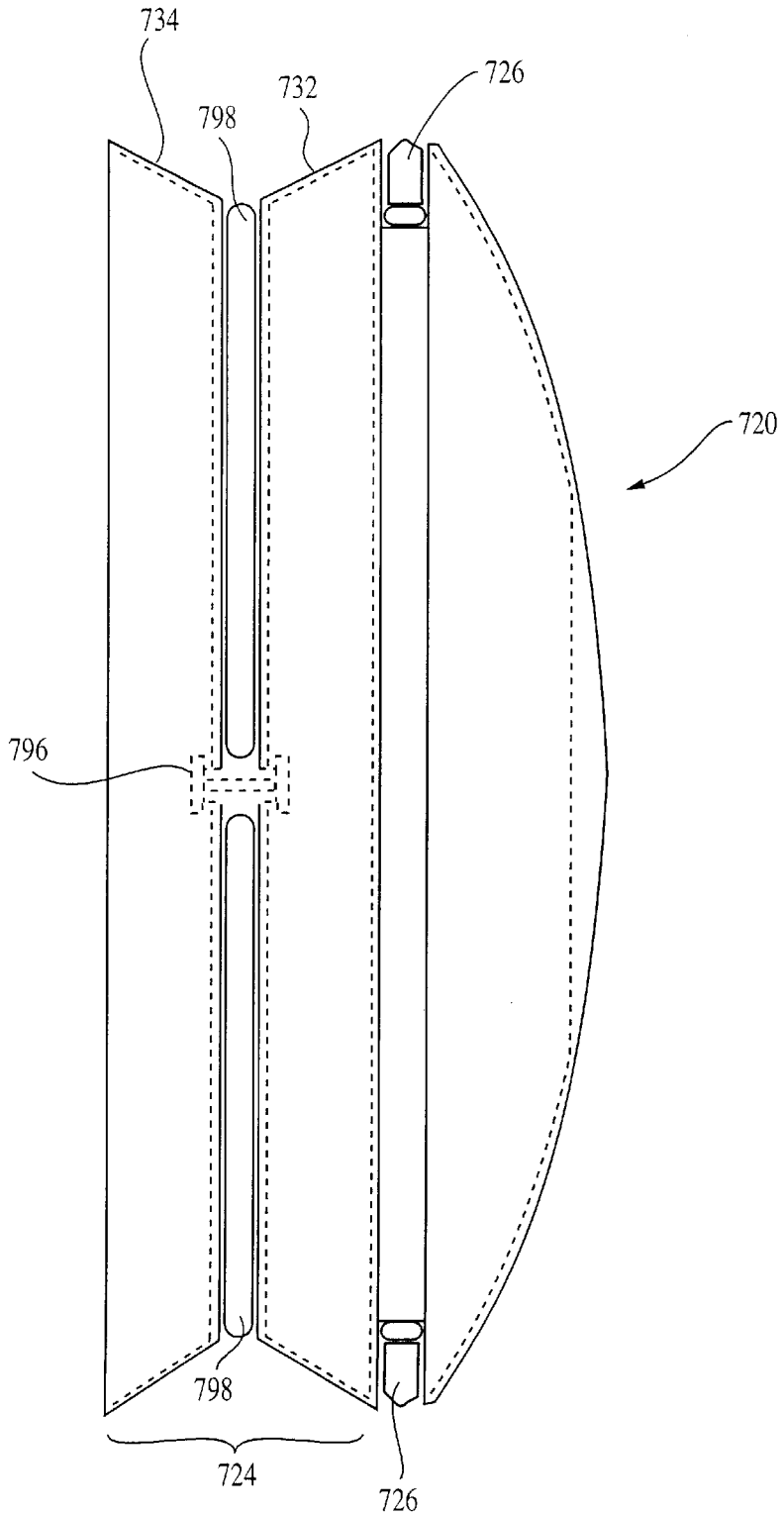
FIG. 18 is a side elevation of a tenth embodiment of a piston.

FIG. 18 shows a tenth embodiment of a piston 720 having an articulating piston shaft 724 with an inflatable bladder 798 between the trapezoidal piston segments 732 and 734. The bladder may be filled with a fluid, such as air, water, glycol, or a gelatinous material, for example. Again, in this embodiment, the trailing piston segment 734 is able to move somewhat independently of the leading piston segment 732 within a small range limited by use of a retainer clip 796. Because the leading piston shaft segment 732 does not move, the articulation of the piston shaft 724 does not affect operation of the wiping seal 726.

In general, it may be appreciated that numerous piston shaft segments can be ganged together and connected with such compressible gaskets to allow the separate segments to move independently. Therefore, providing an articulating piston shaft with such a flexible design allows the piston 20 to glide through a commodity container, even though that container may have some irregularities in the interior tank wall dimensions. These described embodiments provide flexible connections between the leading and trailing piston shaft segments that allow the piston shaft to adjust to variations in the tank walls while still maintaining close tolerance contact with the tank walls. The piston can continuously self-adjust in multiple directions around its 360 degree perimeter.

Figure 19:
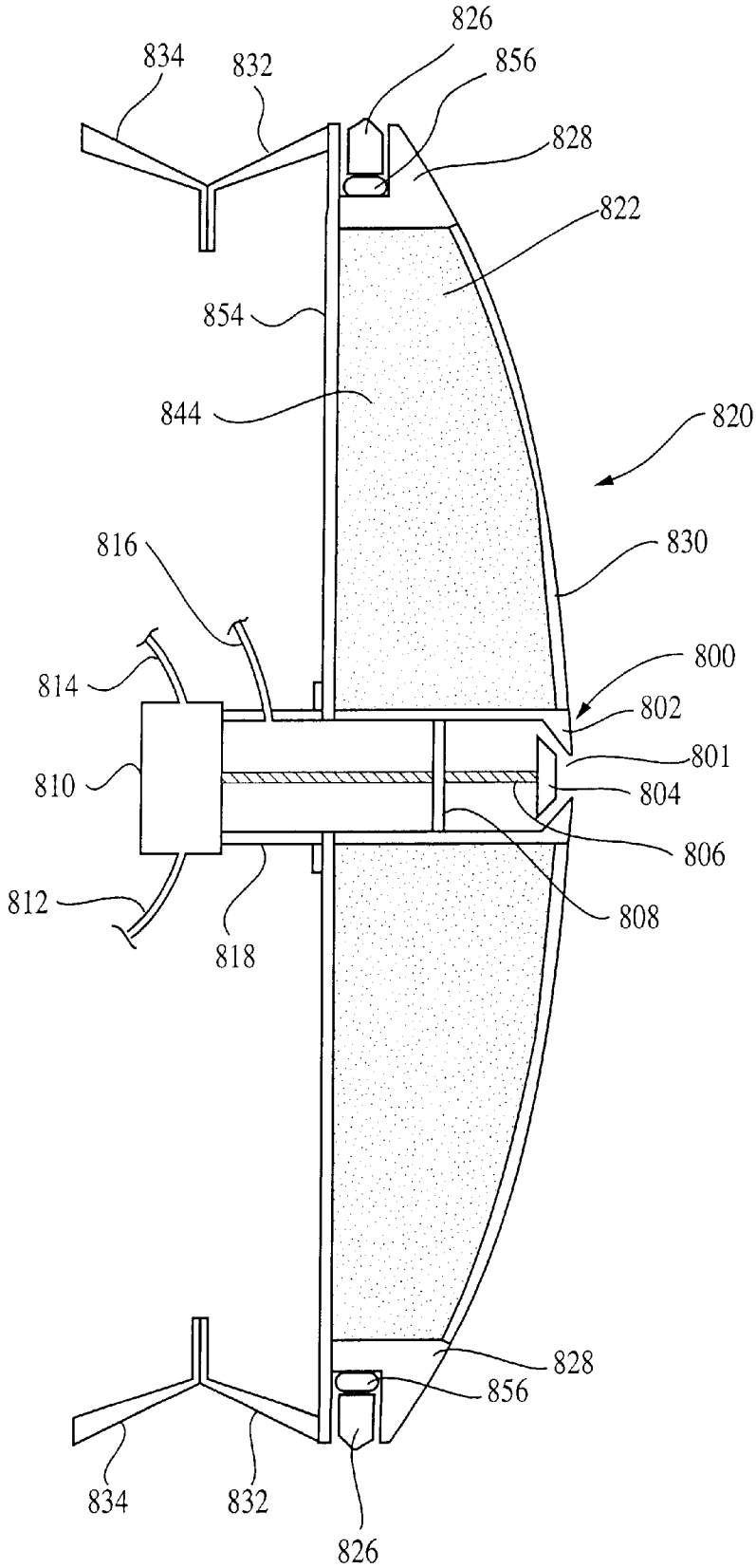
FIG. 19 is a cross-sectional view of an eleventh embodiment of a piston.

FIG. 19 depicts an eleventh embodiment of a piston 820 that has features that are useful to modify the environment on the material or dispensing side of the piston. The piston 820 includes a nose section 822, piston shaft sections 832 and 834, a wiping seal 826, a seal lifter 856 and a piston nose valve 800. The nose section 822 is made up of a compressible nose surface 830, a rigid peripheral ring 828, a rigid foam core 844 and a back plate 854.

The piston nose valve 800 fits through the center of the nose section 822. The piston nose valve 800 includes a valve seat 802 surrounding the valve opening 801 in the center of the nose section surface 830. A valve plug 804 is adapted to move away from or sit tightly against the seat 802, and when sitting against the seat, preferably provides a surface flush with the nose section surface so that there is no recess in which material to be dispensed may accumulate. The valve plug 804 is connected to a valve stem 806 that passes through a stabilizer 808 and connects to a valve actuator 810 sitting on a valve body 818. The valve actuator 810 is shown as double-acting in that two air supply lines 812 and 814 are provided to pneumatically operate the actuator to push the stem 806 and plug 804 against the valve seat 802, or to pull it away. The air supply lines are preferably flexible tubing and connect to remote sources outside of the container in which the piston operates. Of course, other types of pneumatic actuators such as single-action spring-biased types may be used. As well, air operated motors may be used to raise and lower a threaded valve stem. In addition, electrically actuated solenoids may be used to operate the valve, but are less preferred due to expensive precautions for potential hazardous conditions.

A flexible hose 816 is connected at one end to the outside of the container, and at the other end to the valve body 818. The valve body is not open to the back side of the piston (i.e., driving side), but is open only to the front side of the piston (i.e., dispensing side) through the valve opening 801. The flexible hose 816 is used to charge a fluid, such as air or nitrogen to the dispensing side of the piston, or it is used to evacuate the air from dispensing side of the piston.

In operation, the use of the valve 800 can modify the environment on the dispensing side of the piston, or at least the space between the nose section surface 830 and the material being dispensed. One example of such a use is to maintain an air purge on the dispensing side of the piston. Because some commodity materials can prematurely cure in the absence of air, maintaining an air blanket on the material may prevent the material from curing. Likewise, prior to the initial charge of material to a container, the valve may be opened and air (or any gas or liquid) pressured into the container outlet. Then the valve is closed and material is then pumped into the tank.

Similarly, a vacuum can be created with the valve prior to charging material to a container. This is important in some applications to ensure there are no voids or pockets of gas between the nose section and the material charged to the container. For example, when dispensing material into packaging equipment, gas bubbles in the material cannot be tolerated.

In addition, the piston nose valve 800 may be useful for removing or installing a piston in a container. In a vertically oriented container, such as shown in FIG. 2, the piston 820 can be removed after opening the top of the container by pressurizing air through the valve 800 to push the piston upwards towards the opening until it is within easy reach of operators. A piston can be installed in a horizontally oriented piston, such as shown in FIG. 3, by placing it at the open end of the piston and then pulling a vacuum through valve 800 to suck the piston into the closed opposite end of the container in a position ready to receive fresh material. In any manner of operation, however, it is important that the piston wiping seal 826 maintain tight contact with the container wall to seal off and separate the environment on the nose section dispensing side of the piston from the environment on the opposite driving side.

Embodiments of the solid wiping seal of the present invention have numerous advantages that may or may not have been apparent from the foregoing description. The seal lifter that presses the solid wiping seal against the inside of the container wall never comes into contact with the material being dispensed from the tank. This method is superior over other methods presently being used. Other piston designs may use a hollow inflatable seal to wipe the tank wall. The hollow inflatable seal is exposed to the materials in the tank. The chemicals in the materials being dispensed can permeate the hollow inflatable seal, which may result in the hollow inflatable seal developing pinholes in the seal and losing its pressure against the tank wall. When pressure is lost in an inflatable seal, the hollow inflatable seal is unable to wipe the tank walls, and the material being dispensed will by-pass the seal. When this happens, the tank must be opened and both the tank and the piston must be cleaned. All or some of the material that was being dispensed will be lost. Further, if the material being dispensed is reactive to the tank atmosphere on the other side of the piston, then materials being dispensed will prematurely cure and the piston itself can become locked in the tank. This not only results in loss of material but can also mean that the piston itself is damaged in the attempt to unlock the piston from the cured material.

When using a solid wiping seal, the amount of surface area against the tank wall can be easily varied by changing the size and shape of the wiping seal, the durometer of the wiping seal and/or adding a Teflon or nylon bearing ring. This means that high pressure can be used to force the solid wiping seal against the tank wall to ensure firm, effective wiping of the tank wall with the minimal of drag resistance. The Teflon or nylon bearing ring can also reinforce the wiping seal to prevent material by-passing the seal when dispensing highly viscous material.

Another advantage of the preferred embodiment of the invention over piston designs that use the hollow inflatable seal to wipe the tank wall, is a reduced drag. As the hollow tube inflates against the tank wall, the only way for the inflatable seal to ensure firm effective wiping of the tank wall is to increase the pressure in the inflatable seal to the point that the area of the outer surface of the hollow tube against the tank wall increases, i.e., flattens. This creates drag on the wall and means that higher pressures must be used to push the piston through the tank than the proposed piston design. Using a solid wiping seal, pressure can be increased without significantly increasing the wiper surface area in contact with the container wall.

Also, an inflatable wiping seal cannot effectively wipe heavy, viscous, semi-solid materials without material by-passing the inflatable seal. Piston designs that utilize inflatable seals were made to accommodate the variations in the tank wall of tanker trucks. An inflatable seal "gives" and fluctuates to accommodate the tank wall variations. If a heavy, viscous or semi-solid material is being dispensed from a tank with a piston, an inflatable seal will give and fluctuate in response to the force of the material against the seal. This condition results in material by-passing the inflatable seal.

In contrast to an inflatable seal, any wear on the solid wiping seal of the present invention does not reduce the effectiveness of the seal. Further, any wear to the wiping seal surface will not reduce the ability of the wiping seal to be extended against the tank wall. In one embodiment of this invention, a bicycle-type inner tube is used to force outwardly the solid wiping seal. The inflatable type bicycle tube itself does not seal against the container wall. Rather, it is the resilient solid wiping seal that creates an airtight closure against the container wall. The present invention has the advantage that the same wiping seal can be used with embodiments incorporating either mechanical or pneumatic lifters to extend the seal against the tank wall.

Having flexibility in the method of extension is important, because there are materials that can be dispensed from the containers that are volatile when exposed to air. In such a situation, rather than chancing a leak from an air filled inner tube, a mechanical seal lifter would be used to push the solid wiping seal against the tank wall.

Likewise, numerous advantages are found in the preferred embodiment of the invention, because of the nylon or Teflon bearing ribbon placed in the wiping seal surface groove. The nylon or Teflon bearing ribbon allows great pressure to be put to the wall of the tank when dispensing materials from the container, especially highly viscous material. The nylon or Teflon bearing reduces the amount of friction against the wall of the tank (less drag) and reinforces the wiping edges of the expandable solid wiping seal so that the edges do not "give" or fluctuate. This prevents the by-pass of material during the dispensing process, especially when dispensing highly viscous material.

The wiping of highly viscous material requires a rigid, reinforced wiping seal. A flexible type squeegee will not work with highly viscous material. An inflatable seal does not provide the rigidity required for dispensing highly viscous material. Therefore, in highly viscous applications, the solid wiping seal of the preferred embodiments of the present invention is preferably made from harder materials, or the sealing edge is made wider to provide greater rigidity to avoid material bypass.

Because of the tight seal that can be formed between the wiping seal and the tank wall, most of the air under the piston and in the outlet nozzle of the container can be evacuated with a vacuum pump. This means that when a material is first pumped into the tank with a vacuum in the outlet nozzle, there will be almost no entrapped air with the material under the piston. This is extremely important when dispensing material into sensitive metering pumps that must have a continuous flow of materials into the pumps. Any entrapped air in the material can cause unwanted pulsations (uneven discharge of material) from the pump and result in quality control concerns.

In addition, numerous advantages are found in the piston shaft made in accordance with the preferred embodiments of the present invention. The piston shaft may have a variety of shapes to provide the minimum amount of piston shaft surface contact and to reduce friction against the tank wall. This means that the pressure used to push the piston through the tank goes directly to pushing the material out of the tank, and not to overcoming friction between the tank wall and the piston. When the piston is used in a horizontal tank, the various piston shaft shapes provide methods to support the piston in the horizontal position with the minimal amount of surface drag on the bottom side of the piston shaft.

There should be minimal dimensional difference between the inside diameter of the tank and the piston shaft (a close tolerance piston shaft). This means that very little, if any, of the air used to push the piston through the tank reaches the solid wiping seal. The shafts of prior art piston designs have a much smaller diameter than the interior of the tank such that air pressure used to push the piston through the tank reaches the inflatable wiping seal and can cause seal roll-over blowout. Seal roll-over blowout is a condition that takes place when the inflatable seal is exposed to the driving dispensing pressure, or the material being dispensed, and the inflatable seal rolls out of the channel that is holding the inflatable seal. When this happens, the material being dispensed from the tank will by-pass the inflatable wiping seal resulting in material left on the tank wall and behind the piston.

The shaft circumference is constructed so that there are close dimensional tolerances between the shaft surface and the interior surface of the tank wall. This means that canting is not even a consideration in the function and operation of the piston during the filling and dispensing process. For example, if the diameter of the tank is 44 ⅛", the piston diameter is 43 ⅞". This means that there is only ⅛" between the tank wall and the piston member around the whole perimeter of the tank so that the piston cannot cant. Therefore, anti-canting pads or other methods to prevent canting are not needed.

The piston shaft trapezoid or curve sides can be repeated as many times as may be necessary depending on several factors, such as tank diameter, viscosity of the material being dispensed, the pressures required for dispensing, and horizontal dispensing versus vertical dispensing. In horizontal dispensing applications, the shaft may need to be elongated to balance the weight of the piston nose. The elongation can be made by one set of trapezoids or curves or a series of trapezoids or curves.

A further advantage of the invention is found with vertically oriented containers. The wiping seal may be replaced without removing the entire piston from the container, thereby not substantially exposing any commodity material in the container to air. One method to replace the seal in situ is to open the container and remove the piston shaft segment by segment. That is, the piston shaft is disassembled, and each segment removed from the container. The final piston segment is removed, which also removes one side of the recessed seal channel and allows access to the seal, seal lifter, and Teflon ribbon in the channel. These components can be replaced or repaired while the nose section of the piston remains in place in contact with the commodity material. Because the nose section has a close tolerance fit to the container, only a small portion of the commodity material near the container wall is exposed to air. The piston shaft segments may be re-assembled onto the nose section, and the container placed back into service. In this situation, a manufacturer may save a lot of money in repairing damaged seals, because expensive commodity material remaining in the container need not go bad by exposure to air, and thus, is not wasted.

In operation, for example, a piston 20, such as depicted in FIG. 5, is placed in an empty container through a full-diameter open end of the container. The piston is set down to the bottom head (for a vertically-oriented tank), with the nose section 22 sitting with a close fit against the bottom head. The air hose 57, having already been attached at one end to the inner tube nozzle 55, has its other end then attached to the inflation nozzle in the container lid or side wall. Then the container is closed up and the inner tube 56 inflated to the desired pressure to force the wiping seal 26 against the container wall with the desired force. If desired, a vacuum is pulled in the container outlet nozzle to fully draw the nose section 22 against the bottom head and evacuate the outlet nozzle. The outlet valve is closed, and a source of commodity material is then connected to the outlet nozzle. The valve is reopened, and fresh commodity material is charged into the container.

As the commodity material is charged, it pushes up against the piston, forcing it upwards. As the piston is displaced upwards, the gas pressure behind the piston may be released through a pressure regulator or manual relief valve on the top of the container. After the container is charged to its desired level, gas can be pressured into the space behind the piston to force it downward to dispense material as desired. Any suitable means for control of back pressure in that space may be utilized, with the goals that the flow of material out of the container is controlled by that back pressure, or that the back pressure is used to maintain a head on a feed pump connected to the container outlet. The air pressure in the inner tube can be adjusted as needed, while the piston is in the container and the container is closed, to maintain the appropriate seal force to seal against and to wipe clean the container walls.

In one example of dispensing material, a 420 gallon commodity container having a piston of the present invention is filled with 300 gallon of a thick synthetic grease having a viscosity of about 200,000 centipoise. The 300 gallons of grease is evenly and completely dispensed from that container through a 4-inch outlet nozzle in about three to four minutes by applying a gas back pressure of between 6 and 15 psig against the piston.

The described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

What is claimed is:

1. A piston for dispensing material from a commodity container, said piston comprising a nose section, a piston shaft behind the nose section, a recessed channel between the nose section and the piston shaft, a wiping seal in the recessed channel, and a seal lifter positioned in the channel behind the wiping seal, the seal lifter adapted to extend the seal outward beyond the periphery of the piston to come into sealing contact with an interior wall of a container, wherein the seal has a wiping edge formed at the radial end of the seal, the wiping edge having a leading lip and a trailing lip radially extending from the seal, the leading lip and the trailing lip defining a recess therebetween having a ribbon of low friction material positioned therein.

2. The piston of claim 1, wherein the nose section has a convex surface adapted for contact with commodity material in said container.

3. The piston of claim 2, wherein a central portion of the nose section surface is made from a compressible material.

4. The piston of claim 1, wherein the nose section has a convex surface adapted for close fitting contact with a concave opposing surface at an end of a commodity container.

5. The piston of claim 1, wherein the seal is comprised of a solid material.

6. The piston of claim 1, wherein the seal lifter is an inflatable tube.

7. A piston for dispensing material from a commodity container, said piston comprising a nose section, a piston shaft behind the nose section, a recessed channel between the nose section and the piston shaft, a wiping seal in the recessed channel, a seal lifter positioned in the channel behind the wiping seal, and a ribbon of low friction material positioned between the seal lifter and the wiping seal, the seal lifter adapted to extend the seal outward beyond the periphery of the piston to come into sealing contact with an interior wall of a container.

8. A piston for dispensing commodity material from a commodity container, said piston comprising:

a nose section having a generally circular peripheral edge adapted to fit in close proximity to an interior wall of the commodity container, said nose section having a convex surface adapted for contacting said commodity material, a central portion of the nose section surface being made from a compressible material and a peripheral ring being made from a rigid material;

a piston shaft behind said nose section, the piston shaft having at least one generally circular peripheral edge adapted to extend in close proximity to the interior wall of the commodity container;

a recessed channel between the nose section and the piston shaft, the channel having a bottom located radially inward from the peripheral edge of the nose section;

a wiping seal positioned within the recessed channel, said wiping seal having a wiping edge adapted to extend radially outward from the peripheral edge of the nose section and to contact the interior wall of the container, the wiping seal being made of a resilient material capable of expanding radially outward when radial forces are applied thereto; and a seal lifter positioned between the wiping seal and the bottom of the recessed channel, wherein upon actuating the lifter, the lifter applies a radially outward force on the wiping seal to extend the wiping edge to contact the interior wall of the container.

9. The piston of claim 8, wherein the seal lifter is an inflatable tube.

10. The piston of claim 8, wherein the piston shaft comprises a plurality of shaft sections, each section having a varying outer diameter with a largest outer diameter about the same as an outer diameter of the nose section.

11. The piston of claim 10, wherein each shaft section has a tapered outer profile.

12. The piston of claim 8, wherein the seal lifter comprises a plurality of arcuate segments, each segment connected to a radial spoke that is in sliding engagement with a cam located at the center axis of the piston.

13. The piston of claim 8, wherein the piston shaft has a scalloped outer profile.

14. A dispensing piston comprising a nose section, a piston shaft, a recessed channel between the nose section and piston shaft, and a wiping seal placed in the channel wherein the piston shaft includes a plurality of shaft sections and at least one resilient member between at least two shaft sections to allow independent articulation of some of the shaft sections.

15. The piston of claim 14, further comprising a seal lifter positioned in the channel radially inward of the wiping seal, wherein the seal lifter is adapted to be activated after the piston is placed in a commodity container to force the wiping seal radially outward in sealing contact against an interior wall of the container.

16. The piston of claim 15, wherein the seal lifter is an inflatable tube.

17. The piston of claim 14, wherein each shaft section has a varying outer diameter and a greatest outer diameter about the same as an outer diameter of the nose section.

18. The piston of claim 17, wherein each shaft section has a tapered outer profile.

* * * * *